United States Patent [19]

Flender

[11] 4,187,775

[45] Feb. 12, 1980

[54] METHOD OF AND DEVICE FOR TREATING HETEROGENEOUS WASTE

[75] Inventor: Hans F. Flender, Neuss, Fed. Rep. of Germany

[73] Assignee: Matthias Trienekens, Viersen, Fed. Rep. of Germany

[21] Appl. No.: 922,540

[22] Filed: Jul. 7, 1978

[30] Foreign Application Priority Data

Jul. 7, 1977 [DE] Fed. Rep. of Germany ..... 2730671

[51] Int. Cl.[2] ..... B30B 13/00

[52] U.S. Cl. ..... 100/39; 209/930; 241/DIG. 38

[58] Field of Search ..... 209/930, 702–705, 209/3.1, 44.1; 241/DIG. 38; 100/39

[56] References Cited

U.S. PATENT DOCUMENTS

| | | | |
|---|---|---|---|
| 3,579,320 | 5/1971 | Pesses | 241/DIG. 38 |
| 3,595,389 | 7/1971 | Morgan | 209/930 X |
| 3,736,120 | 5/1973 | Tempe | 241/DIG. 38 |
| 3,804,248 | 4/1974 | Talamantz | 209/930 X |
| 4,013,551 | 3/1977 | Feudis | 209/930 |

*Primary Examiner*—Allen N. Knowles

*Attorney, Agent, or Firm*—Becker & Becker

[57] ABSTRACT

A method for treating heterogeneous waste, particularly household garbage and general industrial refuse, e.g. paper, glass or bulk objects such as furniture. The composition of waste supplied to the treating site depends on its source, i.e. household bin or industrial skip, and waste from different sources is supplied through different channels, i.e. by different salvage vehicles. At the site the waste is sorted and treated to obtain selected products e.g. for re-cycling.

To facilitate obtaining the products and to cope with the range of waste suppied to the site, a number of separate bunkers are provided, each for waste from a particular source. The bunkers are arranged in an arc, although they could be in block formation and are accessible to salvage vehicles. The jib or boom of a crane or another mechanical device can sweep over the bunkers and transfer seleced waste to one of a number of manual sorting or distributing belts, preferably three, via optional hoppers. The waste is manually sorted into streams of different waste types which are subsequently broken, separated and graded to give specific products. Streams of like waste from different sorting belts are combined.

19 Claims, 3 Drawing Figures

METHOD OF AND DEVICE FOR TREATING HETEROGENEOUS WASTE

This invention relates to the treatment of heterogeneous waste and, more specifically, to the treatment of such waste in the form of municipal, i.e household garbage, and in the form of general industrial refuse with properties similar to household garbage. Such waste treatment may typically comprise the use of mechanical and non-mechanical, e.g. magnetic and gravity separating processes, in which waste is first deposited in bunkers, and subseqeuntly is loosened, broken, crushed, partly graded, crushed further, screened, sifted and/or precipitated, dried, graded, and finally stored.

German Offenlegungsschrift No. 2,449,689 describes a typical method of treating such waste. It is stated therein that the method is used to grade municipal and industrial refuse. It should be noted that the term "industrial refuse" in principle includes so-called special refuse such as toxic or contaminated waste from industrial and commercial concerns. This may occur only in relatively small quantities and may need specialized treatment or disposal. German Offenlegungsschrift No. 2,449,689 and the present invention are not particularly concerned with this type of special waste.

Industrial refuse with properties similar to those of household garbage can be distinguished from special refuse, for example, according to the IKMI Report "Installation for special refuse incineration in Bavaria", first edition 1977. A definition of the concept of municipal waste can be found also in the printed lecture of P. Gauer "Cost-favorable treatment of municipal waste before final elimination", appearing in the VDI schedule on the occasion of the ENVITEC conference on the protection of the environment from the 7th to 11th February 1977 in Düsseldorf, Federal Republic of Germany. Further information for the conceptual distinction of the various types of refuse, on refuse in general and on the treatment and utilization thereof can be found in the printed lecture of E. Willing entitled "Recovery of useful materials from municipal waste" of Feb. 7, 1977. Finally, reference is made in this connection to the book by E. Keller "Waste economy and recycling", W. Girardet publishing company, Essen, Federal Republic of Germany, first edition 1977, especially to pages 165 et seq. where hitherto known methods are listed together with names, data and flow diagrams.

A process for the treatment of waste is further disclosed in German Offenlegungsschrift No. 2,509,764 which relates to the so-called Aachen process. According to this process, the refuse is crushed and graded into material groups according to density, for which purpose a gas flow and a flowing liquid are used. Thus, pursuant to this process, fine material is first separated by screening, and the residue is decomposed after subsequent crushing by means of a preferably upwardly directed gas flow, into a light fraction and at least one heavy fraction, and the latter is decomposed by means of a flowing liquid into two fractions of different density which are subsequently graded according to their basic constituents. It is, therefore, a process in which a wet stage is essential and which has inherent thereto the problems associated with a wet stage. The Aachen process is suitable virtually only for the treatment of pure household garbage, i.e. residential waste.

The range of industrial refuse with properties similar to those of household garbage also includes the waste from e.g. warehouses, depots and supermarkets, which is similar to household garbage as regards material, but has a different composition and, above all, contains substantially larger individual parts. There are in particular many parts which have been used only once and are frequently still "as new", so that they represent an important, useful material. Of interest is here, above all, packing material of paper, cardboard, wood, plastics, sheet metal and glass, up to bulk refuse size, i.e. pallets. Cookers, refrigerators, washing machines and the like, taken back in part-exchange for new goods also from a considerable part of such industrial refuse, and household garbage or waste itself includes separately salvaged bulk refuse with large objects, for example old furniture. Additionally industrial and/or household garbage may include care tires which can occur in critically large quantities.

A method and installation for the treatment of special types of refuse, for example, only glass and ceramic fragments, is represented for example by the Tonsmeier installation (see "Mindener Tageblatt" of Dec. 9, 1976. In this connection, cleaned fragments are conveyed via a deep bunker to a sorting belt where large foreign materials such as cardboard, stones, clay jars, porcelain plates, etc. are separated by hand. Manual selection by color also takes place. The remaining fragments are conveyed via a magnetic field to an impact pulverizer which is followed by an extractor system.

The grading and separation of certain useful materials is also mentioned in German Offenlegungsschrift No. 2,337,977 and German Offenlegungsschrift No. 2,365,267, and also shown in a prospectus of the firm B. V. Maschinefabriek BOA, Enshede (Netherlands) in connection with a grading installation for paper. In this connection, above the grading bunker there are arranged two parallel sorting belts on which personnel carry out the grading operation in the forward direction.

Household garbage or refuse and industrial refuse similar to household refuse occur in compositions which are so heterogeneous that they fundamentally oppose treatment by an individual method, for example, the Aachen process. The above proposed methods and installations are capable of handling sub-sections, for example, pure residential waste, glass waste or pure bulk refuse. Grading and separating techniques can be applied substantially in such cases. With bulk refuse known shredder installations are used. The proposals do not however provide a self-contained system which can effectively process both household refuse and the above-mentioned industrial refuse together with bulk refuse, such as sofas, and which can recover useful materials. Heretofore the various different salvaging techniques with their corresponding treatment of refuse have not received substantial consideration although it is especially important for the subsequent treatment of household refuse, whether the refuse has been salvaged in a drum-type vehicle or in a press vehicle. Also, refuse receptacles of different sizes have not hitherto been taken into account, although they lead to people disposing of their refuse in different ways which can, in turn, have an effect on the recycling of refuse.

The composition of waste of the type discussed above may differ regionally, i.e. North/South, city refuse/village refuse, so that individual methods and installations, for example, the Aachen process, cannot be generalized immediately. Further, charity organizations for example salvage quantities of refuse such as old paper and glass, which should be utilized, especially as they can serve to improve quality. There are scarcely any chances of selling ungraded fragments. The quality of paper obtained by the known methods can be so poor due to the high proportion of plastics (up to 20%) that paper factories suffer large losses as a result. The splitting of bags of refuse and carrying cases requires high investment for the shredders intended for them, which have to be made so large that bulk refuse parts, such as refrigerators or sofas, can also be processed with them. Furthermore, these machines frequently cause undesirable preliminary crushing of the refuse which has an adverse effect on the quality and quantity of the fractions to be separated.

From the point of view of environmental protection, wet processes present special problems, although they enable the refuse to be separated into its fractions virtually as required. Controlling the purity of waste water from such installations may require such expensive techniques that the profitability of a refuse utilization installation can be made impossible. The consequence thereof is that utilization, i.e. recycling, is abandoned and the entire refuse has to be dumped in a conventional manner, resulting in valuable areas of land being barred from other uses.

It will be appreciated from the foregoing that the type of waste concerned is considerably heterogeneous. Furthermore, the various types of source of waste, such as household dustbins, industrial skips, and so forth will have associated therewith waste of different general compositions. Waste will be salvaged through different channels according to the type of source, i.e. by means of drum or press-type vehicles, by means of industrial skip carriers and so forth.

It is, therefore, an object of the present invention to provide a method of treating such waste delivered to a site via the various different channels, in such a way as to enable selected waste products, for re-cycling or the like, to be obtained in an effective manner.

These and other objects and advantages of the invention will appear more clearly from the following specification in connection with the accompanying drawings, in which.

The method according to the present invention of treating heterogeneous waste and refuse from households and industrial establishments for obtaining useful products is characterized primarily by (a) initially sorting the collected refuse and waste in conformity with the specific technique employed in picking up said waste and refuse, (b) subsequently mechanically sorting and distributing and, if expedient, mixing said initially sorted waste and refuse, (c) manually sorting and distributing the previously mechanically sorted waste and refuse, (d) thereupon carrying out individual regenerating and sorting operations, and (e) in connection with the steps under (d) supra combining like or similar intermediate products obtained by the steps set forth above under (c).

Preferably, the mechanical selection is carried out by a single mechanical element. The subsequent manual selection is preferably carried out at stations operating in parallel. There may be a series relationship between the selection stations.

There should desirably be at least one reception area for each channel of waste delivery to the site, i.e. each salvaging technique. The reception areas may be in the form of bunkers, and are preferably arranged in a compact array, while being simultaneously accessible by various types of salvage vehicles. The bunkers may be in the form of multi-compartment containers. A removing and depositing mechanism, for example a grab-crane can preferably travel over the array, and several sorting belts, constituting the selection stations are advantageously accessible to the mechanism. At least one reception area may be in the form of a container parking place. The bunkers, and preferably also the points of deposition for the selection stations, may be arranged around an arc, with the crane inside the arc and having a grab arranged to sweep around the arc.

Figure 1:
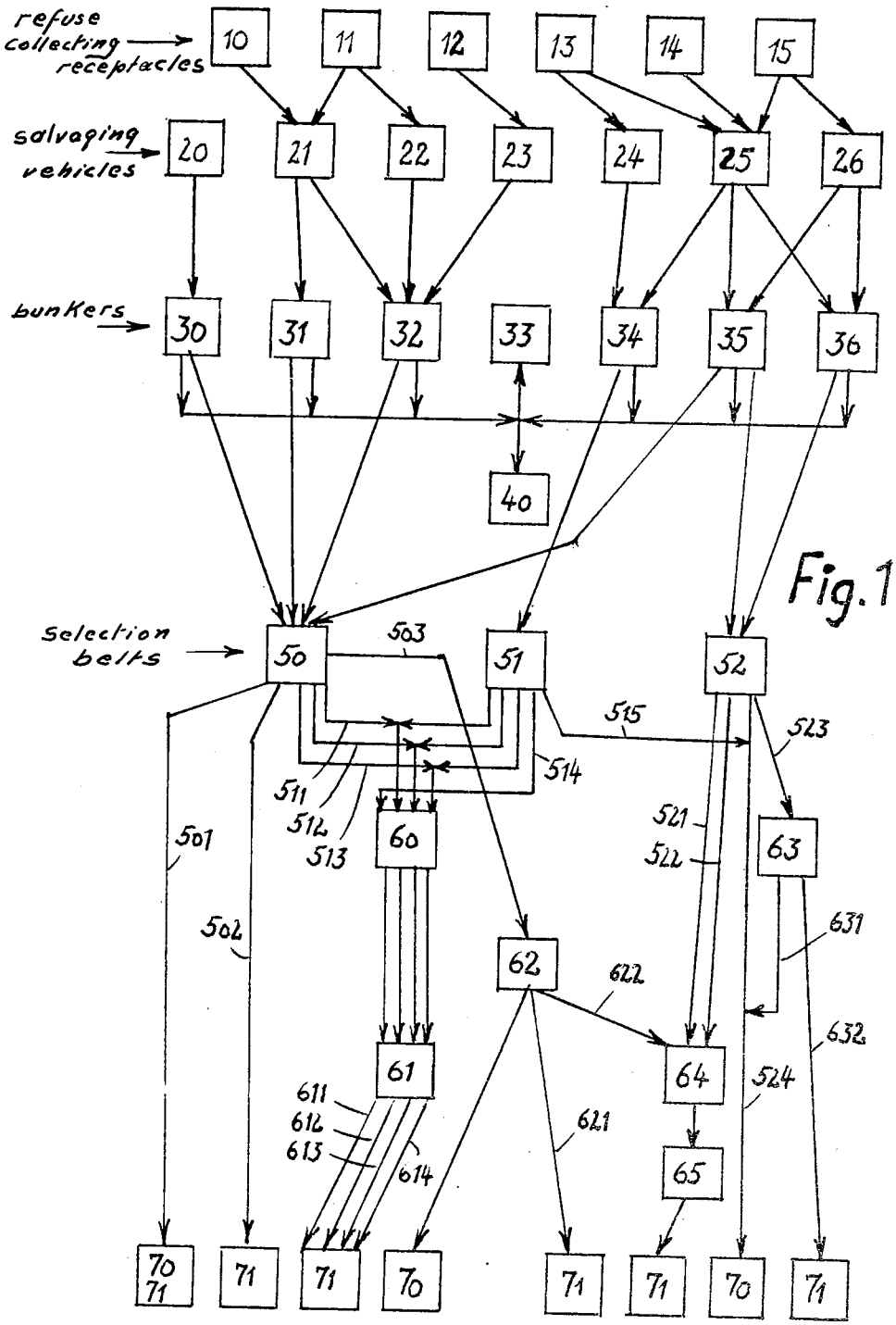
FIG. 1 is a flow diagram illustrating the stages of waste treatment in an embodiment of the method according to the present invention.

Referring now to the drawings in detail, in the flow diagram according to FIG. 1, various stages are represented by squares which bear reference numerals. In the following description the letter "S" stands for "square", in order to simplify the text.

At S 10 a salvaging operation picks up loose bulk refuse, for example, old pieces of furniture and kitchen appliances, which are left by householders on the edge of the road where they are salvaged by special vehicles, especially press vehicles. S 11 represents conventional refuse receptacles, i.e. garbage bins, with a content of e.g. 35, 50 and 120 liters; S 12 designates the refuse receptacles of a multi-compartment system which can be introduced locally to make householders grade their waste at the time of disposal. S 13 denotes refuse receptacles in the form of multi-compartment containers which are used, above all, for industrial waste or refuse similar to household garbage or refuse. S 14 represents containers of a different design ("Multilift") and S 15 represents large containers with a capacity of e.g. 6 to 24 $m^3$. The larger refuse receptacles may contain, in part, paper of a comparatively high quality. This could be a high proportion of corrugated paper even though frequently mixed with packing material of plastics. In addition to the refuse at S 10–15, there is also refuse collected privately which is contributed either by individual persons or by charity organizations, youth groups, etc. in various bundles. This "private refuse", often of high value, is likewise to be delivered for utilization.

The salvaging technique includes not only salvaging receptacles, i.e. the sources of waste, but also salvaging vehicles which are represented at S 20–26. S 20 denotes private cars or vans in which individual persons deliver their refuse. S 21 represents press vehicles, S 22 drum-type vehicles, S 23 multi-compartment salvaging vehicles e.g. of the type developed by the firm Dornier, S 24 dumping and tipping vehicles, S 25 vehicles for special containers and S 26 dumping and tipping vehicles for large containers. Connecting lines and arrows in the flow diagram indicate which vehicles are regularly provided for which refuse receptacles or bulk refuse.

The salvaging operation is followd by delivery of the waste to bunkers at a treatment site, which can be made as tall bunkers of reinforced concrete construction or from sheet metal construction, possibly with plastics lining, or as flat bunkers. The bunkers are arranged next to one another and can be served individually and selectively by the vehicles of the salvaging operation S 20–26. Altogether seven bunkers S 30–36 are marked in the flow diagram according to FIG. 1. S 30 represents a bunker for the refuse from private suppliers, S 31 a bulk refuse bunker, S 32 a two-compartment household refuse bunker, S 33 a bunker designed as a parking place for various containers to receive bulk material, S 34 a three-compartment bunker for glass from an individual salvaging operation, S 35 a bunker for industrial waste or refuse similar to household garbage, and S 36 a bunker for wood and car tires. In the glass bunker at S 34 the three conventional colors of waste glass (white, green, brown) are stored separately. The bunker at S 36 for wood and car tires can also be fitted with two corresponding compartments.

S 40 designates a mechanism which can carry out a mechanical selection and distribution, as well as a mixing operation if necessary. For this purpose a grab crane (Polyp) is preferable which can travel in the manner of a trolley or on rails above or next to the bunkers, although it can also be a stationary crane if the bunkers are arranged in a circle or part circle. A mobile crane can also be used. In addition to the crane at S 40, underground belts can be arranged in the same region, which discharge the bunkers S 30–36 or parts thereof and convey the bunker contents to following stations. Thus at the stage of the method designated S 40 the bunkers contents are selected mechanically and delivered by means of the crane and/or the underground belts to the subsequent stages of the method in a controlled manner. Connecting lines and arrows in the flow diagram indicate which path the individual bunker contents can follow.

The next stage relates to manual selection of specific waste types and is designated by selection stations S 50, 51 and 52 in the flow diagram according to FIG. 1. From a mechanical point of view these are preferably belts on which a manual selecting and distributing operation is carried out by operators. Here, materials can be selected and separated which are not supposed to enter the product in question or which are, for example, highly profitable. Not only a directly manual mode of working is considered, but also an indirectly manual selecting technique e.g. by means of belt deflectors. Also, this stage can include classification by grain size, whereby suitable screening machines can be connected correspondingly in front in order to remove screened material from the belts S 50–52. The interaction between S 40 and S 50–52 represents an essential point of the method by which recovery of useful materials from the salvaged refuse can be fundamentally influenced to advantage.

From the station S 50 a stream 501 for plastics and a stream 502 for non-ferrous metals branch off. Glass is removed both at the station S 50 and at the station S 51, being graded according to color as indicated by the streams 511 for white glass, 512 for green glass, 513 for brown glass and 514 for mixed color glass. The main selection of glass takes place at S 51, since this element receives, delivered by S 40, the glass in S 34, obtained by the separate salvaging operation. However, glass parts also reach the station S 50 especially through private suppliers and through bulk refuse.

The selection station S 52 is intended for the manual selection and distribution of corrugated paper, mixed paper, wood and car tires. Wood and tires are preferably processed in batches, since the incidence of these materials is comparatively low. The streams 521 for corrugated paper, 522 for mixed paper and 523 for wood and tires, which branch off from the station S 52, can be seen in the flow diagram.

Overflows from the three selection stations S 50–52 form streams 503, 515 and 524 which are delivered for continued practicing of the method. The method now consists of individual treatment comprising individual breaking, separating, and grading techniques as represented in the flow diagram by S 60–65. Here, cross connecting streams of like waste types from the various streams formed by the selection stations S 50–52 are provided to ensure collection and consequently achieve enrichment of the product.

The individual treatment region contains firstly a container S 60 with four compartments for the four selected types of glass according to the streams 511, 512, 513 and 514. From here the glass is conveyed to a glass processing installation S 61 centered, for example, on an impact pulverizer with corresponding screens. Streams 611 for white glass, 612 for green glass, 613 for brown glass and 614 for mixed color glass—in the processed form—run from S 61 to the final stage of the method which is yet to be explained. The mixed glass may be subject to a further separating or mixing operation. The overflow from the element S 50 arrives as stream 503 at a grading installation S 62 which can be equipped with conventional mechanical devices, for example, an installation working by the Aachen process. This installation may contain, among other things, a magnetic separator for recovering scrap iron which is conveyed away by the stream 621. Moreover, the installation S 62 is preferably equipped with a screen having a mesh size of 40 mm and also with cutting tools, air sifters, cyclones and corresponding conveyor belts or conveying channels. Graded paper from installation S 62 is conveyed away as stream 622.

The wood and tire fractions in stream 523 from station S 52 arrive by means of conveyor belts at a shredder S 63 with a following magnetic separator. Two streams leave this shredder, namely stream 631 which can be added to the overflow 524 from the station S 52 and stream 632 for wood chips, rubber cuttings or rubber granules and scrap iron.

The paper discharge 622 from the grading installation S 62 is delivered to apparatus S 64 for product mixing, which also receives the streams 521 for corrugated paper and 522 for mixed paper. In this way, various qualities of paper can be admixed at S 64, so that the current demand from consumers can be taken into account. The apparatus S 64 can consist of a belt deflector which is built into the conveyor lines of the streams 521, 522, and 622; however, there can also be simultaneous delivery of the three streams of paper to one funnel. The apparatus S 64 also has the possibility of conveying the individual paper fractions separately, whereby the apparatus also has to serve as a store for adjusting delivery to a following paper bale press S 65.

The last stage of the method is the preparation of the recovered useful waste products for sale or transport. In the flow diagram this stage is marked by S 70 or 71, S 70 representing dumping and S 71 representing sale. For example, the stream of plastics 501 goes either for sale or for dumping, as required, while the streams of useful materials 502, 611–614, 621, 632 and the paper bales supplied by the bale press S 65 are delivered for selling. On the other hand, the discharge from the refuse processing installation S 62 goes for dumping, as do the overflows 515, 524, and 631 from the selection stations S 51–52.

The effect and the advantages of the method and of the installation are substantially determined by the bunkers at S 30 to 36 before the mechanical selection S 40 and the manual selection at S 50–52. In this way, at the very beginning of the process, separation is effected by keeping apart that which is already apart due to the salvaging technique. An overload protection is thereby also obtained, since the mechanical selection S 40 can allow for a particular incidence in the bunkers S 30–36. Flexibility of operation is thereby optimized. Placing the selection stations S 50–52 in front of the grading region enables the quality of the products to be increased, which could not otherwise be achieved. Moreover, production can thereby be provided with critical points, as required. The sum of the measures results in profitability, which is often difficult to achieve in refuse processing and it is also noticeable that only one man (crane driver) needs to be employed in the mechanical selection stage 40. He is, moreover, in a position to separate troublesome constituents, e.g. large sheet metal housings or entire household machines, in order to deliver them for separate utilization (scrap salvaging). The human eye and capacity for thought are therefore consciously incorporated in the cycle of operations, and the expenditure associated therewith is compensated by the specific sequence and form of the stages.

Figure 2:
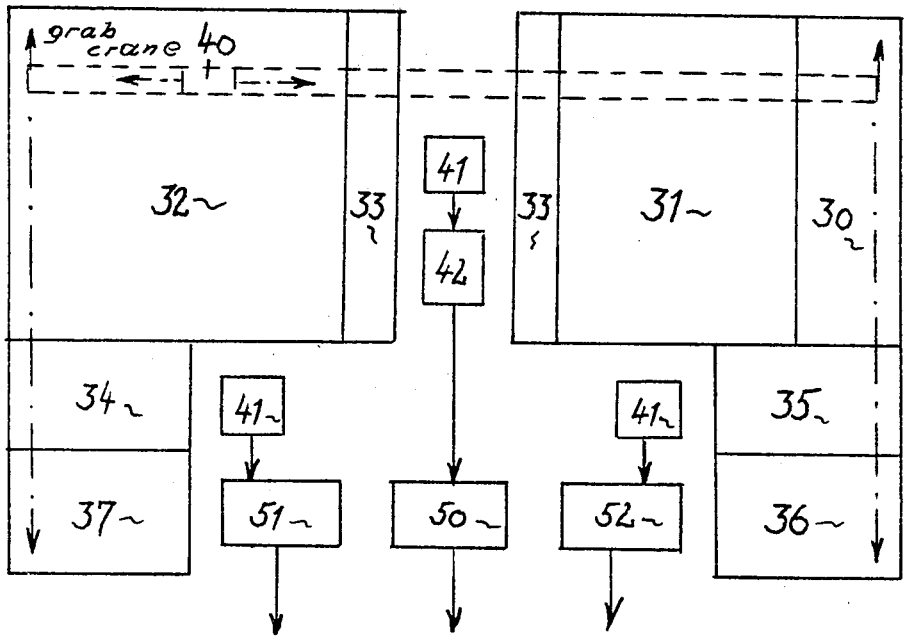
FIG. 2 is a diagram of a bunker arrangement for use in connection with the method of the present invention.

FIG. 2 shows a schematic plan view of a part of an installation for refuse treatment corresponding to the basic flow diagram according to FIG. 1. Thus there is shown an installation in which flat bunkers S 30–37 are provided. While the bunkers S 30–36 correspond to the flow diagram of FIG. 1 and the associated description, the installation according to FIG. 2 includes an additional bunker S 37 which serves as a product store for processed fragments. The bunkers can be approached on three sides by the salvaging vehicles. The individual bunkers are separated from one another preferably by means of colored markings and posts, by means of which the movement of vehicles in the flat bunkers connected to one another is not obstructed.

Here, also is provided a grab crane 40 which can travel in two directions and by means of which the selecting and distributing, as well as, if required, a mixing operation can be carried out. The crane 40 deposits the material taken from the boxes into delivery funnels S 41 which are connected immediately in front of the selection belts S 51 and S 52, or alternatively deposits material onto a screening machine S 42 which transfers the residual thereof onto the belt S 50, while the screened material is delivered, for example, directly to the grading installation S 62 according to FIG. 1.

Figure 3:
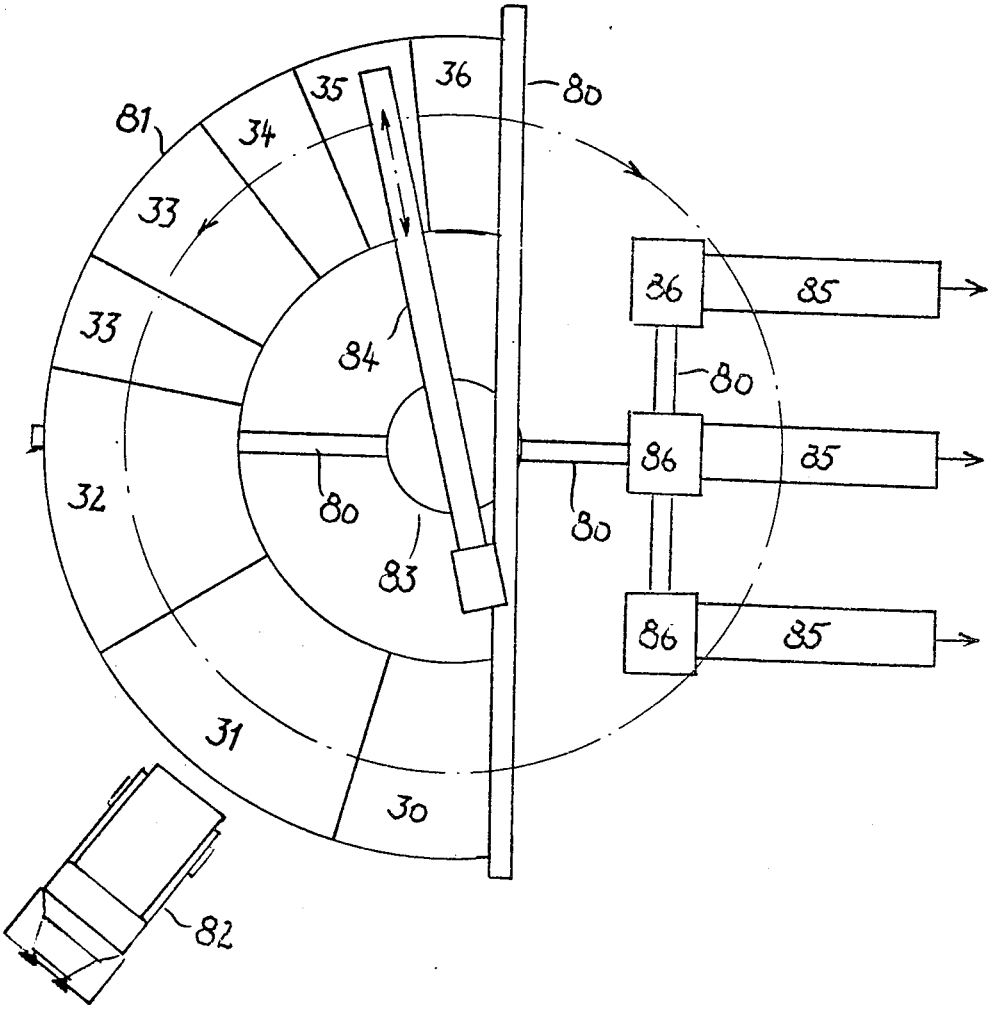
FIG. 3 is a diagram of an alternative bunker arrangement according to the present invention.

The apparatus shown schematically in plan view in FIG. 3, as a constituent or an alternative installation for carrying out the method described, is made in block form and manufactured as a steel constructions, in which connection also concrete finished parts may be used. Arranged in a semi-circle on a supporting grid of supports 80 is a bunker array 81 with seven bunkers 82 corresponding to S 30–36 in FIG. 1. The individual bunkers are accessible towards the outside for the salvaging vehicles such as that shown as 82; these vehicles empty the refuse into the bunkers. In the center of the bunker array 81 there is mounted a crane 83 with beam 84, whose grab can sweep and empty the bunkers S 30–36 arranged in a semi-circle. The grab is guided on the jib 84 by means of a trolley (not shown).

Opposite the bunker array 81 and in close proximity thereto are arranged on the grid 80 three distributing belts 85 corresponding to selection stations S 50 to 52 in FIG. 1, which each carry a delivery funnel or hopper 86. The funnels 86 can be fed by the crane 83. Under the belts 85 there are funnels and connections for conveyors to distribute the selected material to the further processing points shown in FIG. 1. Thus at least in the preferred embodiments there is provided a universally applicable method, in which a wet stage is not essential and which enables household garbage and industrial refuse and waste similar to household garbage to be treated simultaneously, irrespective of the kind of salvaging technique, for achieving different product qualities. Also, it is possible, when the composition of the garbage or refuse varies and when raw material prices change, to establish different critical points in the installation for carrying out the method, without the installation having to be converted for this purpose. It is possible to operate the method and installation effectively and at economically feasible costs.

The particular salvaging techniques used are taken into account by the fact that the homogeneity of the waste materials supplied from a particular source is not disturbed, hence disorder is minimized. Further, the different degree of crushing of the refuse is taken into consideration, so that bulky parts do not disturb the grading operation. Also, there is the possibility of carrying out batch operations which allows adaptation to the possible changes in composition of the refuse and to the varying product demand.

Moreover, the bunkering facility protects the installation against overloading.

Selection by means of a manual selecting and distributing technique is used deliberately, although manual grading is considered unsatisfactory for large-scale recovery of useful materials in the recent book by Keller "Waste economy and recycling", page 135. Gauer and Willing also believe, as stated in their earlier-mentioned lectures, that manual grading is unprofitable, troublesome and inadequate for several reasons. These defects are overcome by the invention, and the advantages of the human ability rapidly to pick out and allocate groups of materials are exploited so that the method as a whole remains profitable and also offers the possibility of bringing these jobs into line with current requirements.

It is, of course, to be understood that the present invention is, by no means, limited to the specific showing in the drawings but also comprises any modifications within the scope of the appended claims.

What I claim is:

1. A method of treating at a treatment site heterogeneous waste from household garbage and industrial refuse, which includes the steps of: at said treatment site providing a plurality of discrete reception areas for respectively receiving waste according to the different general compositions of said waste and according to the respective collecting techniques employed; subsequently carrying out a selection and distribution of the waste at said reception areas; distributing the selected waste into streams of specific waste types; and subjecting said streams of specific waste types to individual treatments comprising at least one of the treatment types of breaking, separating, and sorting to thereby respectively obtain the selected products, while combining streams of like waste types from different selection areas for common treatment.

2. A method according to claim 1, which includes the steps of providing seven reception areas and three selection stations.

3. A method according to claim 1, which includes the step of operating said selection stations in parallel.

4. A method according to claim 1, which includes the steps of providing channels of waste delivery to the treatment site and providing at least one reception area for each channel of waste delivery to said treatment site.

5. A method according to claim 1, which includes the step of providing at least one reception area as a container depositing place.

6. A method according to claim 1, which includes the step of sifting the waste to be treated so as to separate fine material from the waste to be treated and dividing the retained material into a light material portion and at least one heavy material portion and splitting up said last mentioned heavy material portion into two groups and subsequently sorting the same according to their basic components.

7. A method according to claim 1, which includes the step of collecting papers in different streams from the selection stations and combining said streams and subsequently pressing the papers.

8. A method according to claim 1, which includes the step of subjecting the glass of different colors and contained in the material to be treated and collected at the selection stations to an individual treatment according to the respective color of the glass.

9. A treatment plant for treating heterogeneous waste from household waste and industrial refuse, which includes a plurality of discrete reception stations for respectively receiving waste and refuse according to the different general compositions of said waste and refuse, selecting and distributing means provided at said reception stations for respectively selecting said waste and refuse and distributing said waste and refuse into streams of specific waste and refuse types for respectively subjecting said streams to individual treatment, collecting means for collecting streams of like waste and refuse type from said selecting and distributing means for common treatment.

10. A treatment plant according to claim 9, which includes a single mechanical device for mechanically selecting and distributing the waste and refuse at said reception stations.

11. A treatment plant according to claim 10, in which said single mechanical device includes at least one underground conveyor belt.

12. A treatment plant according to claim 10, in which said mechanical device includes a crane.

13. A treatment plant according to claim 9, in which said selecting and distributing means include at least one sorting belt for each selecting means.

14. A treatment plant according to claim 13, in which each sorting belt is provided with a delivery hopper.

15. A treatment plant according to claim 9, in which at least some of said reception stations comprise a bunker.

16. A treatment plant according to claim 15, in which at least some of said bunkers are multi-partioned.

17. A treatment plant according to claim 9, in which said reception stations are arranged in a close array, and said selecting means are in close proximity to said array.

18. A treatment plant according to claim 12, in which said reception stations are arranged in an arc, and in which said crane is operable to sweep around said arc over said reception stations.

19. A treatment plant according to claim 15, which includes an array of bunkers accessible to salvage vehicles, a plurality of sorting belts, and means for selectively transferring waste and refuse from a selected bunker to a selected sorting belt.

* * * * *